US010704881B1

(12) United States Patent
Foltz et al.

(10) Patent No.: US 10,704,881 B1
(45) Date of Patent: Jul. 7, 2020

(54) REMOTELY ACTUATED MULTI-USE MODULAR EXPLOSIVE ORDNANCE DISPOSAL ROCKET DEARMER

(71) Applicant: The United States of America as Represented by the Secretary of the Navy, Indian Head, MD (US)

(72) Inventors: Lee Foltz, Indian Head, MD (US); Dan McCarthy, LaPlata, MD (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 16/602,049

(22) Filed: Jul. 29, 2019

(51) Int. Cl.
*F42D 5/04* (2006.01)
*F42B 33/06* (2006.01)

(52) U.S. Cl.
CPC ..... *F42D 5/04* (2013.01); *F42B 33/06* (2013.01)

(58) Field of Classification Search
CPC ..... F42D 5/04; F42B 33/06; F42B 33/067; F41H 11/12; F41H 11/13–32
See application file for complete search history.

(56) References Cited

U.S. PATENT DOCUMENTS

| | | | | | |
|---|---|---|---|---|---|
| 2,519,905 | A * | 8/1950 | Hickman | F42B 30/10 | 102/377 |
| 3,750,979 | A | 8/1973 | Nelms et al. | | |
| 4,779,511 | A * | 10/1988 | Proctor | F42B 33/06 | 86/50 |
| 4,957,027 | A | 9/1990 | Cherry | | |
| 7,047,862 | B1 * | 5/2006 | Davis | F41G 1/46 | 89/1.13 |
| 7,997,179 | B1 | 8/2011 | Nelson et al. | | |
| 8,276,495 | B1 * | 10/2012 | Chiu | F41A 21/485 | 42/1.08 |
| 9,127,920 | B2 | 9/2015 | Joseph et al. | | |
| 9,534,864 | B2 | 1/2017 | Dey | | |
| 10,066,916 | B1 * | 9/2018 | Vabnick | F42B 12/74 | |
| 10,495,433 | B1 * | 12/2019 | Langner | F42D 5/04 | |

FOREIGN PATENT DOCUMENTS

| | | | | |
|---|---|---|---|---|
| GB | 2230846 A * | 10/1990 | F41A 21/28 | |
| GB | 2473808 A * | 3/2011 | F42B 33/06 | |

* cited by examiner

*Primary Examiner* — Gabriel J. Klein
(74) *Attorney, Agent, or Firm* — Fredric J. Zimmerman

(57) ABSTRACT

A novel dearmer enables EOD technicians to propel dearmer projectiles using conventional electric .50 caliber blank cartridges or conventional non-electric 12 gauge blank cartridges. The dearmer projectiles may render energetic threats safe without requiring an opposing force to offset the recoil. The conventional blank cartridge functions as a rocket motor that supplies gas to a converging/diverging nozzle. Alternatively, liquid is loaded into the dearmer (creating a liquid rocket effect) and the EOD projectile is propelled toward a target from the end of the dearmer opposite the liquid.

10 Claims, 3 Drawing Sheets

REMOTELY ACTUATED MULTI-USE MODULAR EXPLOSIVE ORDNANCE DISPOSAL ROCKET DEARMER

STATEMENT OF GOVERNMENT INTEREST

The invention described herein may be manufactured and used by or for the Government of the United States of America for Governmental purposes without the payment of any royalties thereon or therefor.

FIELD OF THE INVENTION

The invention relates in general to explosive ordnance disposal (EOD) and in particular to apparatus for propelling dearmer projectiles to render various energetic threats safe.

BACKGROUND OF THE INVENTION

Some conventional technology used to render energetic threats (for example, fuzes coupled to warheads, etc.) safe rely on using high pressure cartridges to build up pressure inside of a barrel. The high pressure in the barrel propels a projectile/slug out of the barrel and causes the projectile/slug to impact the threat location. An apparatus that uses this conventional technology is, for example, the MK 2 Dearmer. The MK 2 Dearmer uses interior ballistics to propel the projectile forward. The forward velocity of the projectile is partly due to the entire large mass of the barrel that offsets the recoil as the projectile travels down the barrel. However, EOD technicians require lightweight equipment to enable manual transportation of the equipment on long distance missions. To propel a projectile fast enough, high pressure is required. In conventional technology, such as the MK 2 Dearmer, for example, the barrel size and large mass is dictated by the high internal pressure.

A need exists for a lightweight apparatus to propel EOD projectiles and render energetic threats safe.

SUMMARY OF THE INVENTION

One aspect of the invention is a dearmer including a blank cartridge configured to create propulsion gas. An air-tight insert is disposed around the blank cartridge and conforms to an exterior profile of the blank cartridge. An EOD projectile is disposed adjacent a base of the blank cartridge. An outer sleeve is disposed around the air-tight insert. A converging/diverging nozzle is disposed adjacent to an end of the blank cartridge, which is opposite the base of the blank cartridge and is fixed to the outer sleeve. The converging/diverging nozzle is configured to receive the propulsion gas and thereby propel the dearmer toward a target.

In one exemplary embodiment, the EOD projectile is attached to the outer sleeve. In another exemplary embodiment, the EOD projectile is integral with the outer sleeve.

The dearmer may include a rupture disk disposed between the end of the blank cartridge opposite the base of the blank cartridge and the converging/diverging nozzle.

The dearmer may be disposed in a launch tube prior to ignition of the blank cartridge.

In another aspect of the invention, the converging/diverging nozzle is omitted and a volume of liquid is disposed adjacent an end of the blank cartridge opposite the base of the blank cartridge and is contained in the air-tight insert such that the propulsion gas impacts the volume of liquid and propels the dearmer toward a target.

The invention will be better understood, and further objects, features, and advantages thereof will become more apparent from the following description of the exemplary embodiments, taken in conjunction with the accompanying drawings.

BRIEF DESCRIPTION OF THE DRAWINGS

In the drawings, which are not necessarily to scale, like or corresponding parts are denoted by like or corresponding reference numerals.

DETAILED DESCRIPTION OF THE INVENTION

A novel dearmer enables EOD technicians to propel various dearmer projectiles using conventional electric .50 caliber blank cartridges or conventional non-electric 12 gauge blank cartridges. The dearmer projectiles may render energetic threats safe without requiring an opposing force to offset the recoil. In one exemplary embodiment, the conventional blank cartridge functions as a rocket motor that supplies gas to a converging/diverging nozzle. In another exemplary embodiment, liquid is loaded into the dearmer (creating a liquid rocket effect) and the EOD projectile is propelled toward a target from the end of the dearmer that is opposite the liquid.

Figure 1:
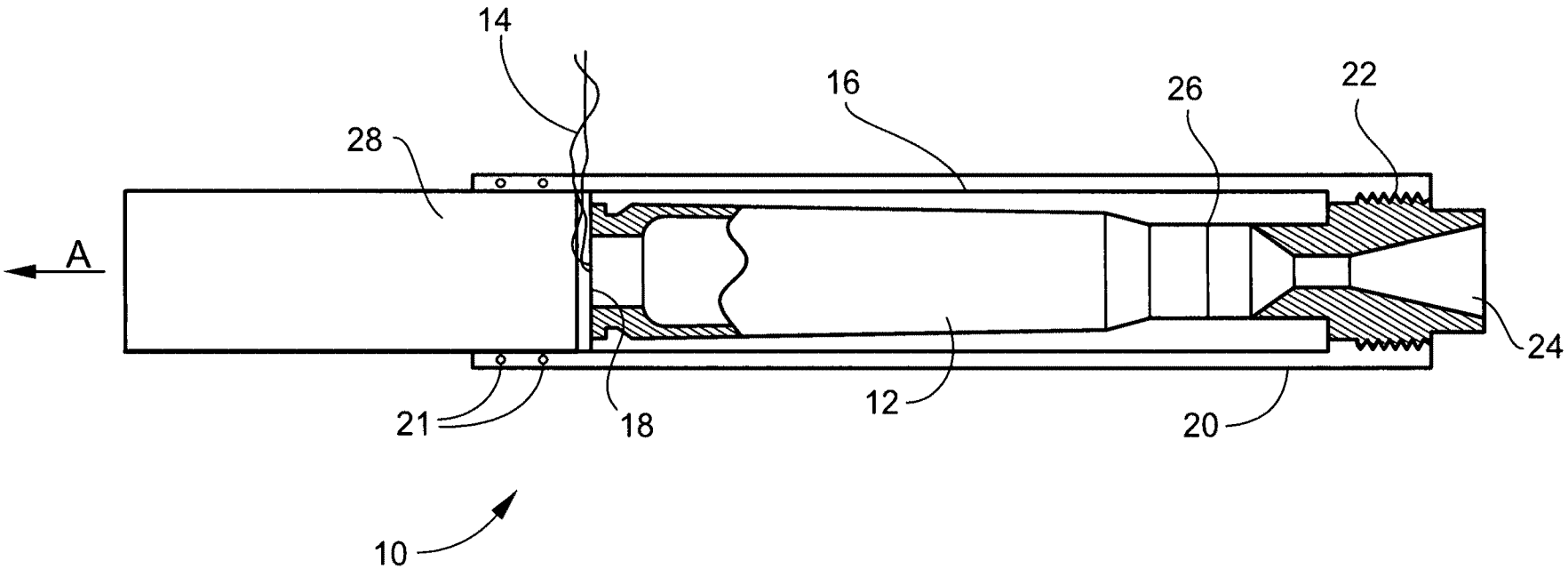
FIG. 1 is a cutaway side view, partially in section, of one exemplary embodiment of a dearmer.

FIG. 1 is a cutaway side view, partially in section, of one exemplary embodiment of a dearmer 10. Dearmer 10 includes a blank cartridge 12, for example, a conventional electric .50 caliber blank cartridge or a conventional non-electric 12 gauge blank cartridge. In the case of an electric blank cartridge, the cartridge is remotely initiated via lead wires 14 that lead from the base 18 of cartridge 12 to a remote location. In the case of a non-electric blank cartridge, the cartridge is remotely initiated via a shock tube (not shown) that extends from the base of the blank cartridge to a remote location. Blank cartridge 12 is surrounded by an air-tight insert 16 that conforms to the exterior profile of blank cartridge 12. Insert 16 may be made of light weight material, for example, aluminum, plastic or wood.

An EOD projectile 28 is disposed adjacent base 18 of the blank cartridge 12. EOD projectile 28 may be made of, for example, steel, tungsten, metal alloys, and composites. Projectile 28 may be, for example, a conventional dearmer projectile. Conventional dearmer projectiles include a standard slug, a flat head slug, a chisel head slug, a wedge slug and a forked slug, for example. Key parameters of an EOD slug include velocity, diameter, material of construction, length, mass, etc. These parameters are important to produce the needed exterior and terminal ballistics.

An outer sleeve 20 is disposed around the insert 16. Outer sleeve 20 may be made of, for example, steel, carbon fiber or titanium. The thickness of outer sleeve 20 may be, for example, in a range of about 0.125 inches to about 0.375 inches. Outer sleeve 20 may be designed for a single use or multiple uses. For single use, the wall thickness of outer sleeve 20 may be less than for multiple uses because the sleeve 20 need not survive repeated pressure loadings. For single use designs, the sleeve 20 may be allowed to permanently deform thereby enabling use of a thinner wall thickness compared to multiple use designs where permanent deformation is not desired. For multiple use configurations, lightweight materials and/or composites may be used, such as carbon fiber, titanium, etc. In the instant invention, it is desirable to minimize the weight of the entire assembly because the rocket actuation will be moving the entire mass (blank cartridge 12, insert 16, outer sleeve 20, nozzle 24 and EOD projectile 28) forward toward the target. By contrast, in conventional dearmer technology, it is generally not desirable to minimize the magnitude of the recoiling mass (barrel) because the barrel is freely flying backwards and a lower recoiling mass can diminish the forward velocity of the projectile.

A converging/diverging nozzle 24 may be disposed adjacent an end of the blank cartridge 12 opposite the base 18 of the blank cartridge and fixed to outer sleeve 20. Nozzle 24 may be fixed to outer sleeve 20 with a threaded connection 22, for example. In the exemplary embodiment of FIG. 1, outer sleeve 20 also partly surrounds projectile 28. Projectile 28 may be fixed to sleeve 20 with threads (not shown) or O-rings 21, for example. A rupture disk 26 may be disposed between the end of the blank cartridge 12 opposite the base 18 of the blank cartridge and the converging/diverging nozzle 24.

Figure 2:
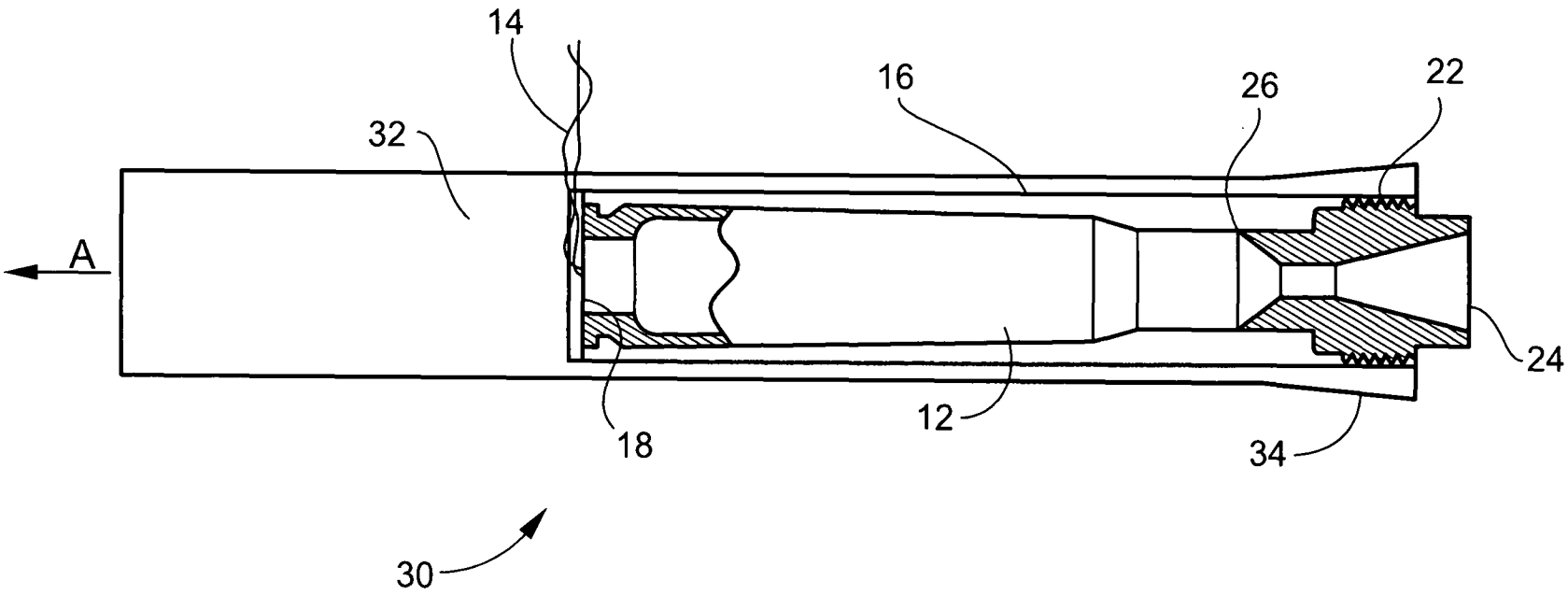
FIG. 2 is a cutaway side view, partially in section, of a second exemplary embodiment of a dearmer.

FIG. 2 is a cutaway side view, partially in section, of a second exemplary embodiment of a dearmer 30. Dearmer 30 is similar to dearmer 10 except that the EOD projectile 32 is formed integrally with the outer sleeve 34.

Figure 3:
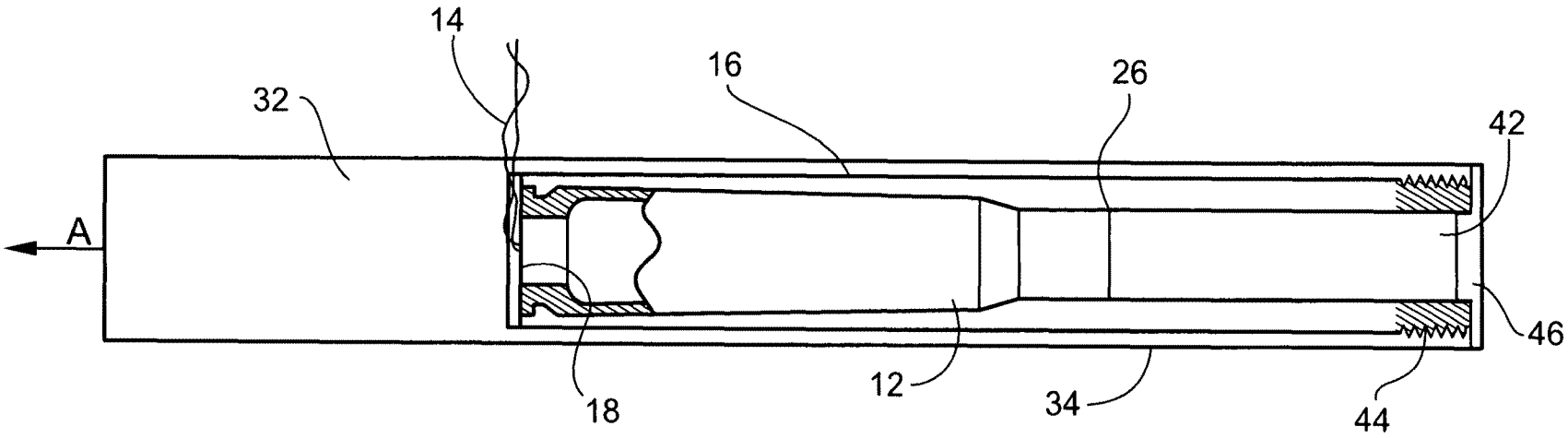
FIG. 3 is a cutaway side view, partially in section, of a third exemplary embodiment of a dearmer.

FIG. 3 is a cutaway side view, partially in section, of a third exemplary embodiment of a dearmer 40. Dearmer 40 is similar to dearmer 30 except the converging/diverging nozzle 24 is replaced with a column of liquid 42 in the interior of insert 16. Liquid 42 may be, for example, water. Insert 16 may be fixed to outer sleeve 20 with a threaded connection 44, for example. A seal 46, such as a plastic cap seal, may be used to contain liquid 42 in insert 16 until blank cartridge 12 is ignited. The propellant gas created by blank cartridge 12 impacts liquid 42 in insert 16 to create a liquid rocket.

Figure 4:
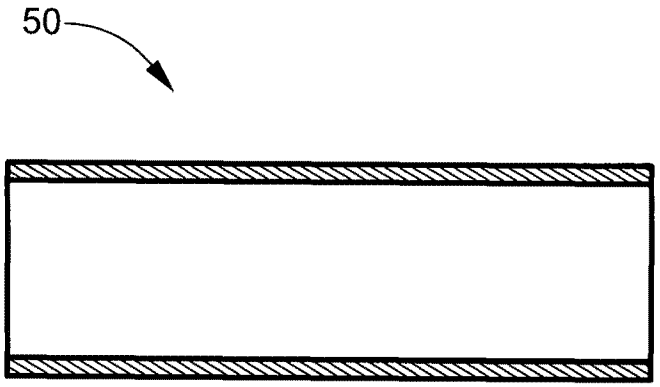
FIG. 4 is a side sectional view of a launch tube.
Figure 5:
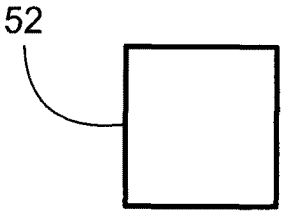
FIG. 5 Conventional Art
FIG. 5 is a schematic drawing of a target energetic threat.

FIG. 4 is a side sectional view of a launch tube 50. Tube 50 may be a thin-walled tube made of, for example, plastic or carbon fiber. Dearmer 10 or 30 or 40 may be placed in launch tube 50 prior to ignition of the blank cartridge 12. Alternatively, dearmer 10 or 30 or 40 may be placed on a rail (not shown) prior to igniting the blank cartridge 12. The dearmer is ejected from the thin-walled tube 50 or runs along the rail until the propellant in the blank cartridge 12 is expended. Thus, the EOD projectile 28 or 32 and the entire dearmer assembly are projected toward the desired target 52 (FIG. 5) in a direction opposite the direction of the propulsion gases that are exhausted from the blank cartridge 12. In FIGS. 1-3, the projectile 28 or 32 and the dearmer assembly are projected in the direction shown by arrow A.

The overall assembly is very much lighter than conventional dearmers because a high-strength pressure vessel is not required in the novel dearmer to contain and direct high-pressure propellant gas. In addition, there is no rearward recoil with the novel dearmer. In a conventional gun barrel, gas pressure builds up and pushes against a heavy, solid projectile until it exits the barrel. In the novel dearmer, gas pressure builds up but does not push against a heavy projectile. Rather, the gas is moved at high velocity through a nozzle (or against a column of liquid) to create force. A conventional gun barrel uses gas pressure to move a heavy solid mass at a lower velocity. The novel dearmer uses a lightweight gas mass that moves at a much higher velocity through a nozzle (or against a column of liquid).

Any numerical parameters set forth in the specification and attached claims are approximations that may vary depending upon the desired properties sought to be obtained by the present invention. At the very least, and not as an attempt to limit the application of the doctrine of equivalents to the scope of the claims, each numerical parameter should at least be construed in light of the number of significant digits and by applying ordinary rounding.

What is claimed is:

1. A dearmer, comprising:

a blank cartridge being configured to create propulsion gas;

an air-tight insert being disposed around the blank cartridge and conforming to an exterior profile of the blank cartridge;

an EOD projectile being disposed adjacent a base of the blank cartridge;

an outer sleeve being disposed around the air-tight insert; and a converging-diverging nozzle being disposed adjacent an end of the blank cartridge that is opposite the base of the blank cartridge and fixed to the outer sleeve, wherein the converging-diverging nozzle is configured to receive the propulsion gas and thereby propel the dearmer toward a target to dearm the target.

2. The dearmer of claim 1, wherein the EOD projectile is attached to the outer sleeve.

3. The dearmer of claim 1, wherein the EOD projectile is integral with the outer sleeve.

4. The dearmer of claim 1, wherein the blank cartridge is one of an electric .50 caliber blank cartridge and a non-electric 12 gauge blank cartridge.

5. The dearmer of claim 1, wherein the EOD projectile is a conventional EOD slug.

6. The dearmer of claim 1, further comprising a rupture disk being disposed between the end of the blank cartridge opposite the base of the blank cartridge and the converging-diverging nozzle.

7. The dearmer of claim 1, further comprising a launch tube, wherein the dearmer is disposed in the launch tube prior to ignition of the blank cartridge.

8. A method of dearming an energetic threat, comprising:

providing the dearmer of claim 1;

igniting the blank cartridge;

moving the propulsion gas through the converging-diverging nozzle; and propelling the dearmer toward the target.

9. The method of claim 8, further comprising, before igniting the blank cartridge, placing the dearmer in a tube.

10. The method of claim 8, wherein said igniting the blank cartridge includes igniting one of an electric .50 caliber blank cartridge and a non-electric 12 gauge blank cartridge.

* * * * *